US006763673B2

(12) United States Patent
Oberley et al.

(10) Patent No.: US 6,763,673 B2
(45) Date of Patent: Jul. 20, 2004

(54) REMOTE DISTRIBUTOR WITH INTEGRATED CHECK VALVE

(75) Inventors: Brian J. Oberley, Monroeville, IN (US); Jeffrey D. Gleckler, Convoy, OH (US); Darryl D. Miller, Ft. Wayne, IN (US)

(73) Assignee: Parker-Hannifan Corporation, Cleveland, OH (US)

( * ) Notice: Subject to any disclaimer, the term of this patent is extended or adjusted under 35 U.S.C. 154(b) by 0 days.

(21) Appl. No.: 10/463,118

(22) Filed: Jun. 17, 2003

(65) Prior Publication Data

US 2004/0035134 A1 Feb. 26, 2004

Related U.S. Application Data

(60) Provisional application No. 60/405,444, filed on Aug. 22, 2002.

(51) Int. Cl.[7] ..... F25B 13/00; F25B 30/00

(52) U.S. Cl. ..... 62/324.6; 62/511; 62/525

(58) Field of Search ..... 62/324.6, 324.1, 62/197, 160, 511, 524, 525, 527

(56) References Cited

U.S. PATENT DOCUMENTS 3,029,614 A * 4/1962 Klatt et al. ..... 62/511
3,120,743 A 2/1964 Wilson
3,482,415 A * 12/1969 Trask ..... 62/324.1
4,104,044 A * 8/1978 Lange ..... 62/324.6
4,224,961 A 9/1980 Schnabel
4,263,787 A * 4/1981 Domingorena ..... 62/324.6
4,266,405 A * 5/1981 Trask ..... 62/324.1
4,601,305 A 7/1986 Nordskog
4,633,681 A 1/1987 Webber
5,184,473 A 2/1993 Day

FOREIGN PATENT DOCUMENTS

DE 1191240 4/1965

* cited by examiner

*Primary Examiner*—Harry B. Tanner
(74) *Attorney, Agent, or Firm*—Joseph J. Pophal

(57) ABSTRACT

At least one bypass assembly for use in a heating-refrigeration system having a distributor body with a first and second orifice, an inner chamber and a plurality of fluid passages integrated within, and a conduit connected to the distributor body. The conduit has a first end that connects with a component in the heating-refrigeration system, a second end that connects to the first orifice of the distributor body and a third end connected to the second orifice of the distributor body. A metering device is integrated into the conduit. The second orifice of the distributor body has a valve seat integrated therewithin and the conduit has at least one inwardly projecting indentation located in close proximity to the third end of the conduit. A ball is positioned between the valve seat and the inwardly projecting indentations for reciprocating movement therebetween.

17 Claims, 4 Drawing Sheets

REMOTE DISTRIBUTOR WITH INTEGRATED CHECK VALVE

CROSS-REFERENCE TO RELATED CASES

The present application claims the benefit of the filing date of U.S. Provisional Application Serial No. 60/405,444 filed Aug. 22, 2002, the disclosure of which is incorporated herein by reference.

FIELD OF THE INVENTION

The present invention generally relates to refrigeration-heating systems, and more particularly to a distributor bypass assembly having an integrated ball-type check valve.

BACKGROUND OF THE INVENTION

Heating-refrigeration systems generally utilize distributor assemblies in order to evenly distribute a refrigerant fluid over a component such as an evaporator or a condenser. Such distributor assemblies are typically comprised of several components including a distributor body, a metering device, such as an expansion valve, and a check valve. The check valve is used to bypass the metering device when it is not desired to have the refrigerant flow through the metering device. The check valve, normally being a separate discrete component installed into the distributor assembly, necessitates added fabrication and installation steps and their associated expenses. The present invention provides a simplified integral check valve which is easily manufactured and assembled at a relatively low cost.

Prior art, such as U.S. Pat. No. 3,120,743 to Wilson sets forth an example of a refrigeration system utilizing a metering device and distribution means in order to adequately dispense refrigerant entering into an evaporator. This structure does not provide a way to bypass the metering device when it was not necessary for the refrigeration system. Other prior art references, such as U.S. Pat. No. 4,633,681 to Webber provides an expansion device combined with a check valve. This design is a complicated integration of the expansion device and the check valve involving several parts and is difficult to manufacture.

Other prior art designs, such as U.S. Pat. No. 5,184,473 to Day, provide structures to open and close the path of refrigerant flows from several evaporators to other components. Although this design relates to the avoidance of refrigerant through a metering device, the valve involved is a separate component that is not integrated into other components, such as a distributor body. Another prior art design, U.S. Pat. No. 4,601,305 to Nordskog provides a check valve in an air conditioning compressor unit. This design is unlike the present invention in that it does not have a valve seat incorporated into one component and the separate valve stop is not defined by indentations in a cylindrical tube.

Prior art design U.S. Pat. No. 4,224,961 to Schnabel shows a valve member that can reciprocate between a closed and an open position within a tubular element. The valve stop and valve seat in this design are comprised of separate elements, distinct from the componentry in the assembly. Another design, for an automobile window washer, is shown in prior art German patent 1,191,240. In this design both the valve stop and the valve seat are integrated in the single-piece thermoplastic housing molding.

Not directly related to the scope of the present invention but rather disclosing a method of manufacturing a check valve contained within a tube is shown in U.S. Pat. No. 4,611,374 to Schnelle et al., and details the process of forming seat indentations around a poppet.

SUMMARY OF THE INVENTION

The present invention provides a remote distributor with an integrated check valve for use in a heating-refrigeration system. This invention overcomes the obstacle of having to provide and assemble a separate check valve component as part of the distributor assembly by providing a cost-effective alternative having fewer parts.

A feature of the present invention is to provide at least one bypass assembly having a distributor body with a first and second orifice, an inner chamber and a plurality of fluid passages integrated within, and a conduit connected to the distributor body. The conduit has a first end which connects with a component in the heating-refrigeration system, a second end which connects to the first orifice of the distributor body and a third end connected to the second orifice of the distributor body. A metering device is integrated into the conduit. The second orifice of the distributor body has a valve seat integrated there within and the conduit has at least one inwardly projecting indentation located in close proximity to the second end of the conduit. A ball is positioned between the valve seat and the inwardly projecting indentations for reciprocating movement therebetween.

The previously noted assembly may further include one operating condition in which the cooperation between the valve seat and the ball cause same to function as a check valve while in another operating condition the at least one inwardly projecting indentation cooperates with the ball to permit fluid bypass. Another feature includes the bypassing of an expansion device that can be a capillary tube or a thermal expansion valve.

The previously noted assembly may additionally include a branch in the conduit having a leading end located between the conduit first end and the conduit second end and having a trailing end defined by the conduit third end. The noted assembly may also locate the metering device between the branch leading end and the conduit second end.

Another feature of the present invention includes having two oppositely-directed distributor bypass assemblies located in series. During the heating mode, the ball is sealingly positioned in the valve seat in one of the two bypass assemblies when a fluid flows from the conduit first end towards the conduit second end. During the cooling mode, the ball is in physical contact with the inwardly projecting indentations in one of the two bypass assemblies when fluid flows from the conduit third end towards the conduit first end.

A further feature of the present invention includes positioning the distributor bypass assembly such that the plurality of fluid passages have a first end at the inner chamber and a second end positioned at an inlet for an evaporator. Yet another feature of the previously noted assembly includes having the noted component in the refrigeration system as a high pressure condenser.

The previously noted assembly may even further have a feature where the at least one inwardly projecting indentation is a dimple that decreases the cross-sectional area of the conduit at the dimple and serves a dual function of locating the ball while allowing fluid to pass between the ball and the adjacent conduit. Another feature includes having the curvature of the valve seat match the curvature of the ball.

As previously described the features of the present invention serve to provide a distributor bypass assembly in a heating-refrigeration system that includes an integrated check valve. Further features and advantages of the present invention will become apparent to those skilled in the art upon review of the following specification in conjunction with the accompanying drawings.

DETAILED DESCRIPTION OF THE PREFERRED EMBODIMENT

Figure 3B:
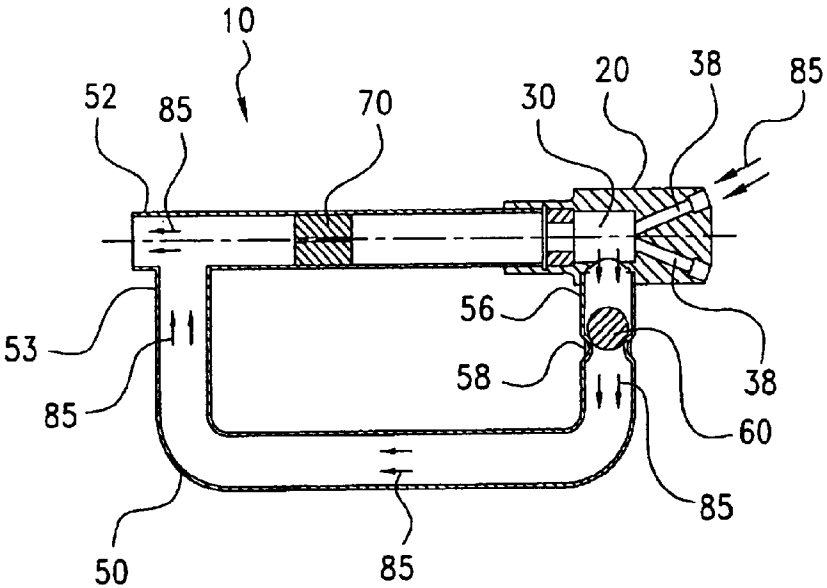
FIG. 3*b* is a view similar to that of FIG. 3*a* with the check valve shown in an opened position.
Figure 3A:
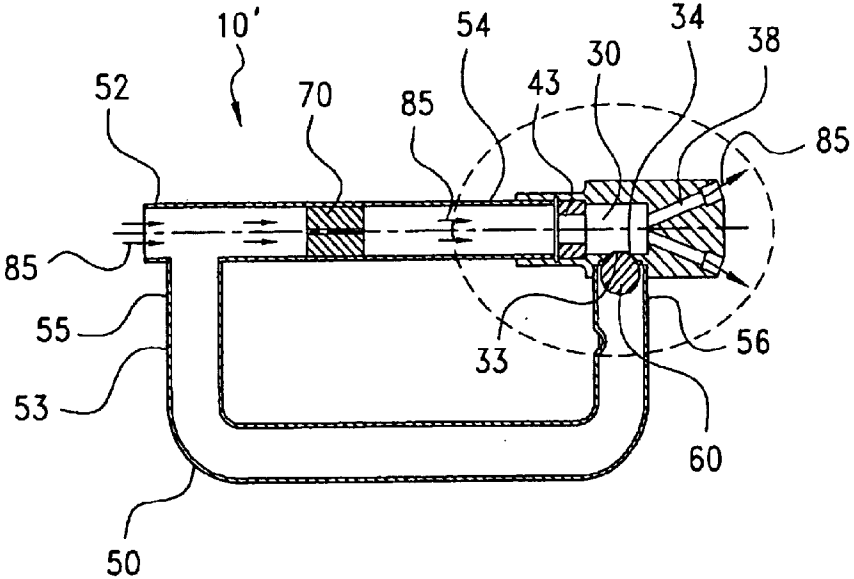
FIG. 3*a* is a cross-sectional view of the present invention having a closed check valve integrated into the distributor assembly and shown in a closed position.

Referring to the drawings, and initially briefly to FIGS. 3*a* and 3*b, a* distributor assembly 10', and 10, for a heating-refrigeration system is shown. Distributor assembly 10 is comprised of a distributor body 20, a contoured conduit 50 connected at two of its ends to distributor body 20 and a metering device 70, which can take the form of an expansion device.

Figure 5:
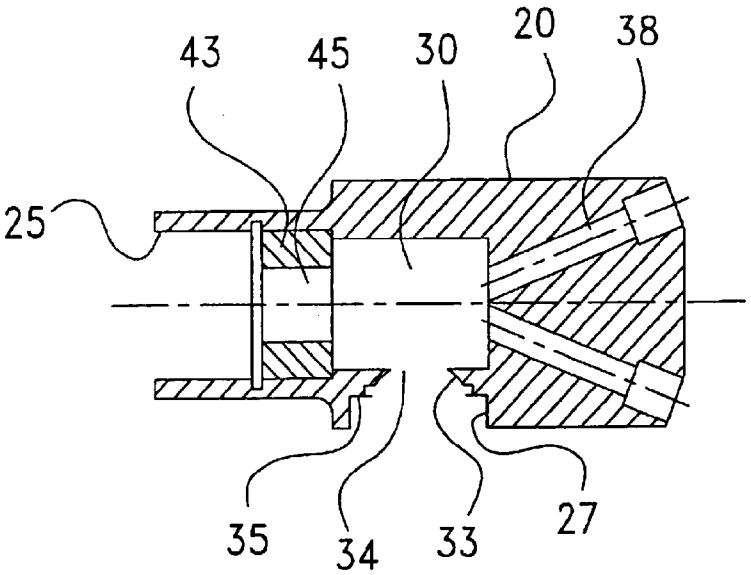
FIG. 5 is a view similar to that of FIG. 4 detailing the distributor body without the connected conduit.
Figure 4:
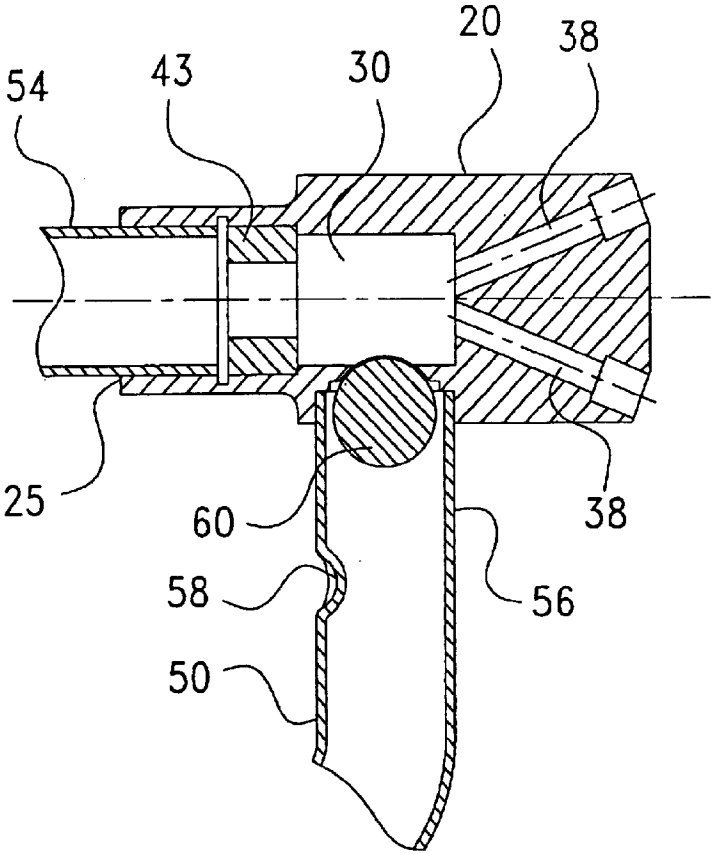
FIG. 4 is an enlarged view of the area circled in FIG. 3*a* detailing a distributor body and a connected conduit.

Referring to FIGS. 4 and 5, distributor body 20 has a first orifice 25 and a second orifice 27 for receiving ends of conduit 50. Within second orifice 27, a valve seat 33 is formed in distributor body 20 and defines a hole 34 having a smaller diameter than second orifice 27. Along the outer portion of second orifice 27 is an annular chamfer 35, machined into distributor body 20, for receiving the one end of conduit 50 prior to its permanent attachment to distributor body 20. A nozzle 43 is placed inside first orifice 25 and provides a smaller diameter hole 45 than that at first orifice 25. Holes 34, 45 lead into an inner chamber 30 within distributor body 20. Another end of conduit 50 is received within orifice 25 and is adjacent nozzle 43. In order to permanently attach conduit 50 to distributor body 20, a braze or weld joint is generally utilized. Inner chamber 30 leads to multiple fluid passages 38 which connect distributor assembly 10 to one or more components, such as an evaporator or a condenser for example, in the heating-refrigeration system.

Figure 1:
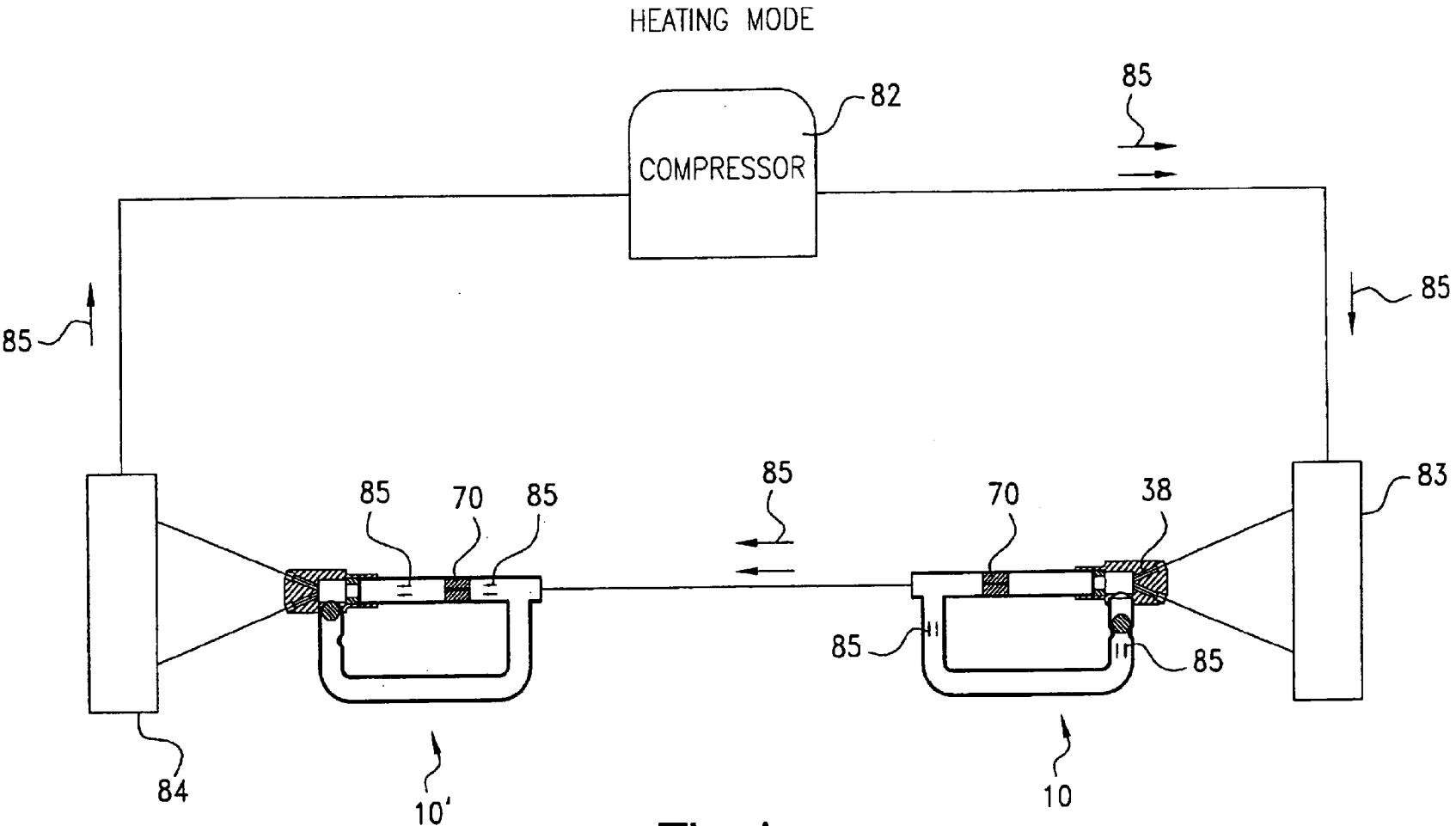
FIG. 1 is a simplified schematic diagram of a reverse cycle refrigeration-heating system with the present invention installed therein and showing same in a heating mode.

Referring to FIGS. 3*a* and 5, conduit 50 has three ends. A first end 52 is connected to a component (as shown in FIG. 1) in the heating-refrigeration system. The second end 54 is received within distributor body first orifice 25. The third end 56 is received within distributor body second orifice 27. An extension 53 branches off conduit 50 between first end 52 and second end 54. Extension 53 has a first end 55 and its second end is defined by conduit third end 56. Metering device 70 is located between extension first end 55 and conduit second end 54. Conduit 50, in the vicinity of conduit third end 56, has at least one inwardly projecting indentation 58 in its outer diameter. Each indentation 58 will be placed in the same planar region along the circumference of conduit 50, thus reducing the inner diameter of conduit in only this area. Indentations 58 will be in close longitudinal proximity to conduit third end 56. A check ball 60 is placed into conduit third end 56 and is confined between distributor body 20 and indentations 58. Check ball 60 can longitudinally travel or reciprocate between inward indentations 58 and valve seat 33. As best shown in FIG. 4, check ball 60 is sealingly received by valve seat 33 when it reaches conduit third end 56 at distributor body 20.

Figure 2B:
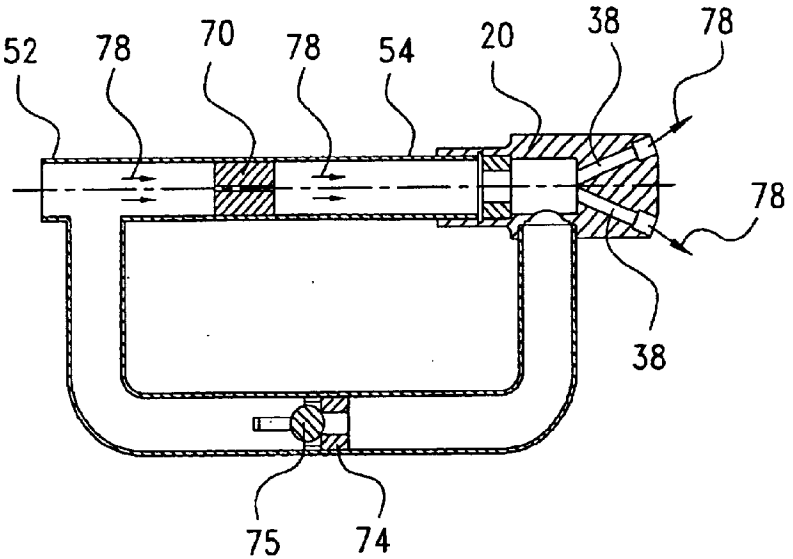
Fig. 2b (PRIOR ART)
FIG. 2*b* is a view similar to that of FIG. 2*a* with the check valve shown in a closed position.
Figure 2A:
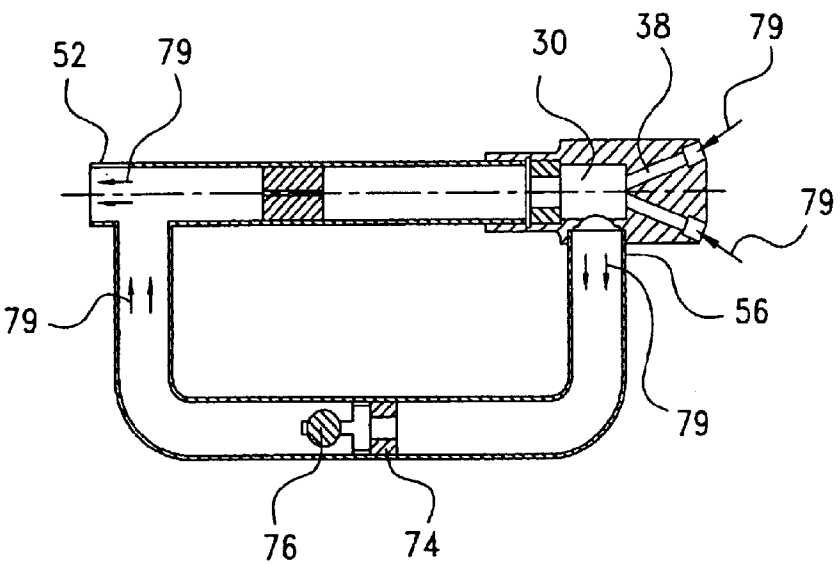
Fig. 2a (PRIOR ART)
FIG. 2*a* is a cross-sectional view of a prior art check valve integrated into a distributor assembly and shown in an opened position.

Referring now to FIG. 1, distributor assemblies of this type have particular application in a reverse cycle refrigeration system as commonly used for air conditioning and heating purposes. In such systems, it is common to provide metering devices, such as a temperature or pressure operated expansion valve, at the entry of each heat exchanger coil 83 and 84. This type of system requires a check valve around each metering device in order to bypass the metering device when it is unused. A typical, prior art, distributor assembly is shown in FIGS. 2*a* and 2*b* which depict altered versions of FIGS. 3*a* and 3*b* in order to show the placement of a separate prior art check valve 74, while all other features are similar to the embodiments of the present invention. Therefore, the remaining reference numbers in FIGS. 2*a* and 2*b* will be identical to those of the present invention. In FIG. 2*b*, the flow direction of refrigerant is shown by arrow 78. With flow direction 78, check valve 74 is in a closed position 75 and all refrigerants will flow from conduit first end 52, through metering device 70, continue through conduit second end 54 into distributor body 20, and flow out therefrom via fluid passages 38. When the refrigerant flow is reversed, as is shown by flow direction arrows 79 in FIG. 2*a*, the refrigerant flow enters fluid passages 38, continues through distributor inner chamber 30, flows into conduit third end 56, flow through check valve 74, which is in an open position 76, and finally out of conduit first end 52.

As best seen in FIGS. 4 and 5, the present invention has eliminated the expense of a fully separate check valve 74 within conduit 50 via the integration of valve seat 33 into distributor body 20 and the check stop member into inwardly projecting indentations 58 of conduit 50. This simplified assembly eliminates an additional component, i.e. check valve 74, and provides an efficient bypass assembly that is easily manufactured, assembled and used.

Referring back to FIG. 1, the function of the overall assembly will now be discussed. The heating-refrigeration system, and array of componentry, is well known in the art. The inventive features of the present invention focus on distributor assembly 10. For explanatory purposes, the heating mode will be discussed. It should be evident that the refrigerant flow in the cooling mode is opposite to that of the heating mode. In the heating mode of a heating-refrigeration system, high pressure, high temperature refrigerant gas exits a compressor 82, flows through a conduit in the direction shown by arrows 85, and enters an indoor coil 83, which for the heating mode can take the form of a condenser. Indoor coil 83 condenses the high pressure, high temperature gas into a liquid as it passes through a series of coils inside indoor coil 83. This is accomplished as heat is transferred from the refrigerant gas to the air or liquid passing over coils (not shown per se) of indoor coil 83. In the present invention, two distributor assemblies 10 and 10' are positioned in series. Fluid enters fluid passages 38 and travels into inner chamber 30 within distributor assembly 10 (as best shown in FIG. 3*b*). Fluid then enters conduit third end 56, thus positioning check ball 60 against the one or more inwardly projecting indentations 58. Due to the direction of flow, fluid bypasses expansion device 70 by traveling through conduit extension 53 and exits at conduit first end 52. Fluid flows through a conduit connecting distributor assembly 10 and enters second distributor assembly 10', as shown in FIG. 3*a*.

The fluid enters second distributor assembly 10' (as best seen in FIG. 3*a*) at conduit first end 52. Due to the direction of fluid flow 85 and the system pressure, check ball 60 is seated at valve seat 33 and prevents fluid from flowing through hole 34 in distributor body 20. The fluid flows through expansion device 70 that converts the fluid which at this time is a high pressure, high temperature liquid, into a low temperature gas/liquid mix. This low temperature gas/liquid mix flows past conduit second end 54, through nozzle 43, which in turn helps to homogenize the mix, and into inner chamber 30. The now gas/fluid mix branches off into fluid passages 38 and is distributed over a series of coils (not shown per se) in an outdoor coil 84, which can take the form of an evaporator. Air which is flowing over the evaporator coils transfers heat to the gas/fluid mix, which boils into a superheated gas. The gaseous refrigerant then returns to compressor 82 to repeat the cycle.

As is well known in the art, in order to switch over to the cooling mode, a typical reversing valve, not shown, is actuated, and the refrigerant from compressor 82 flows in the opposite direction of arrows 85 in FIG. 1. Indoor and outdoor coils 83, 84 reverse functions, such that indoor coil 83 acts as an evaporator, and outdoor coil 84 functions as a condenser. Therefore, high-pressure refrigerant gas flows from compressor 82 into outdoor coil 84, which acts as a condenser. The refrigerant within outdoor coil 84 passes in heat exchanger relationship with a cooling medium and is condensed into a cooled fluid. This fluid bypasses metering device 70 in distributor assembly 10', flows through extension 53 and out of first orifice 25. The fluid flow continues into distributor assembly 10, which as described above, is in series with distributor assembly 10', and its first orifice 25. Due to the direction and pressure of the fluid check ball 60 has seated into valve seat 33, as best shown in FIG. 3*a*, thus forcing fluid through metering device 70, which acts as an expansion device. Fluid is evenly distributed through fluid passages 38 into indoor coil 83, which acts as an evaporator. As the refrigerant fluid passes through each of the coils it expands and cools the air passing over indoor coil 83 in a heat exchanging relationship. The expanded refrigerant then flows back to compressor 82 to repeat the cooling cycle.

The use of an integrated check valve seat 33 in distributor body 20 in combination with the insertion and confining of check ball 60 by indentations 58 of conduit third end 56 simplifies a distributor assembly with the elimination of a separate check valve within conduit 50. This significantly reduces the cost and manufacturing process for a heating-refrigeration system.

It should be noted that the present invention is not limited to the specified preferred embodiment and the enunciated principles. Those skilled in the art to which this invention pertains may formulate modifications and alterations to the present invention. These changes which rely upon the teachings by which this disclosure has advanced are properly considered within the scope of this invention as defined by the appended claims.

What is claimed is:

1. At least one distributor bypass assembly for use in a heating-refrigeration system having a distributor body with a first orifice, a second orifice, an inner chamber and a plurality of fluid passages integrated therewithin, a conduit having a first end in fluid connection with a component in the heating-refrigeration system, a second end sealingly connected to the first orifice of said distributor body and a third end sealingly connected to the second orifice of said distributor body, and a metering device integrated into said conduit, wherein:

the second orifice also defines a valve seat, said conduit having a cylindrical body portion with at least one inwardly projecting indentation located in close proximity to said third end of said conduit, and a ball positioned between said valve seat and said at least one inwardly projecting indentation for reciprocating movement therebetween.

2. The at least one distributor bypass assembly as in claim 1 wherein said valve seat cooperates with said ball in one operating condition to function as a check valve and said at least one inwardly projecting indentation cooperates with said ball in another operating condition to permit fluid bypass.

3. The at least one distributor bypass assembly as in claim 2 wherein said metering device is an expansion device which is bypassed in said another operating condition.

4. The at least one distributor bypass assembly as in claim 3 wherein said expansion device is a capillary tube.

5. The at least one distributor bypass assembly as in claim 3 wherein said expansion device is a thermal expansion valve.

6. The at least one distributor bypass assembly as in claim 1 wherein said conduit has a branch with a leading end located between said conduit first end and said second end and has a trailing end defined by said conduit third end.

7. The at least one distributor bypass assembly as in claim 6 wherein said metering device is located between said branch leading end and said conduit second end.

8. The at least one distributor bypass assembly as in claim 1 wherein said ball is sealingly positioned in said valve seat when a fluid flows from said conduit first end towards said conduit second end.

9. The at least one distributor bypass assembly as in claim 1 which includes two oppositely directed distributor bypass assemblies located in series.

10. The distributor bypass assemblies as in claim 9 wherein, during a heating mode in the heating-refrigeration system, said ball is sealingly positioned in said valve seat in one of the two bypass assemblies when the fluid flows from said conduit first end towards said conduit second end.

11. The distributor bypass assemblies as in claim 9 wherein, during a cooling mode in the heating-refrigeration system, said ball is in physical contact with said at least one inwardly projecting indentation in one of the two bypass assemblies when the fluid flows from said conduit third end towards said conduit first end.

12. The at least one distributor bypass assembly as in claim 1 wherein said ball is in physical contact with said at least one inwardly projecting indentation when fluid flows from said conduit third end towards said conduit first end.

13. The at least one distributor bypass assembly as in claim 1 wherein a counterbore is placed around the perimeter of said second orifice and sealingly receives said conduit third end.

14. The at least one distributor bypass assembly as in claim 1 wherein said plurality of fluid passages have a first end positioned at said inner chamber and a second end positioned at an inlet for an evaporator.

15. The at least one distributor bypass assembly as in claim 1 wherein said component in the refrigeration system is a high-pressure condenser.

16. The at least one distributor bypass assembly as in claim 1 wherein said at least one inwardly projecting indentation is a dimple which decreases a cross-sectional area of said conduit at said dimple which serves a dual function of locating said ball while allowing fluid to pass between said ball and said adjacent conduit.

17. The at least one distributor bypass assembly as in claim 1 wherein said valve seat has a curvature that matches the curvature of said ball.

* * * * *